United States Patent [19]

Maurice

[11] Patent Number: 4,532,783

[45] Date of Patent: Aug. 6, 1985

[54] DOUBLE LOCK LOCK BOX

[76] Inventor: Thomas A. Maurice, 9111 Orangevale Ave., Orangevale, Calif. 95662

[21] Appl. No.: 433,981

[22] Filed: Dec. 27, 1982

[51] Int. Cl.[3] ..... E05B 65/48

[52] U.S. Cl. ..... 70/63; 70/162

[58] Field of Search ..... 70/63, 14, 52, 53, 158–162, 70/163–169; 109/23, 52

[56] References Cited

U.S. PATENT DOCUMENTS

| | | | |
|---|---|---|---|
| 3,436,937 | 4/1969 | Barrett | 70/63 |
| 3,979,932 | 9/1976 | Piche | 70/63 |
| 4,325,240 | 4/1982 | Gable | 70/63 |

*Primary Examiner*—Robert L. Wolfe

*Attorney, Agent, or Firm*—Leonard Bloom

[57] ABSTRACT

A key safe having a shackle to secure the key safe to a door knob or the like and a first locking means associated with the shackle to allow installation and removal of the key safe. The key safe has an interior chamber accessed through a removable cover secured by a second locking means independent of the first locking means. Thus the owner or occupant of a premises can provide limited access to the premises for a real estate agent or other authorized person by installing the key safe on the exterior of a door to the premises with a key to the premises contained therein.

16 Claims, 4 Drawing Figures

DOUBLE LOCK LOCK BOX

BACKGROUND OF THE INVENTION

The present invention relates generally to article safes, and more specifically to a key safe with one locking means providing limited access to an interior chamber and a second locking means locking and securing a shackle which attaches the key safe to a door knob or the like.

It is often desirable to provide limited access to premises such as a domicile, an office, or a business residence so that authorized persons such as servicemen, repairmen, or realtors may enter the premises to perform their services and leave without the necessity of owner or authorized occupant being present. In less precarious times this could have been accomplished by either leaving the door of the premises open, or discretely placing a key under the door mat or elsewhere. However, the security risks attendant with modern society require severely restricting the availability of the key or information necessary to gain access to the premises.

A good example of the modern security crisis in providing limited access to a premise is that encountered by the realtor and the home owner in showing the property to a perspective client. Timing arrivals and departures of everyone so that paths cross simultaneously is difficult at best; therefore it is necessary for the realtor to have access to the premises while the owner is not there. Furthermore, it is often the case that many different realtors must be able to gain access because the premises is listed with a number of different brokers. Each broker must be provided with ready access to the premises in order to service the owner efficiently.

Various devices exist in the prior art which attempt to address themselves to these goals, and the state of the art of which applicant is aware comprises the following U.S. patents:

| | | | |
|---|---|---|---|
| 1,436,937 | Barrett | 3,636,742 | Raney |
| 2,911,814 | Williams | 1,955,809 | Hobbs |
| 2,813,620 | Hansen | 3,712,091 | Parent |
| 3,695,067 | Bays | 3,979,932 | Piche |

Of the above citations the reference to Barrett is of interest since the device disclosed therein is widely used and is conceptually representative of all the other citations except that to Piche, which will be distinguished hereinafter.

The disclosure in Barrett provides a chamber with a locking door permitting access thereto and a shackle arm connected to an upper portion of the chamber permitting the chamber to be secured and locked to a door knob or the like. Once the chamber is accessed through the locked door any key contained therein may be removed and the latch for the shackle arm may be released so that the entire chamber can be disengaged from the door knob and removed. Thus, anyone having a key to the door may access the chamber, remove the contents and unlatch the shackle and remove the chamber itself; conversely one without a key may not remove the contents of the chamber or the chamber itself. The key operatively associated with the chamber door must be, and is a universal type key since many different realtors and their agents must have access to the premises. Thus, all the realtors and real estate agents that are associated with a particular realty board are issued nonduplicable universal keys which will open any chamber associated therewith. There are a number of severe problems associated with this type of arrangement.

Often times it takes months to find a buyer for the property or premises, and throughout that entire period the owner or occupant must endure the insecurity and inconvenience of having a key safe attached to his front door knob, knowing that there can be one thousand or more universal keys that will allow access to the chamber of the lock box containing the key to the premises. Thus, anyone who obtains one of the universal keys to the locked box such as that disclosed in Barrett may also obtain / access to any premises with such a lock box attached to the front door knob of the premises. Furthermore, if someone does gain unauthorized possession of a universal key and burglarizes a premises, collecting insurance presents severe problems to the home owner since there is no forced entry. Because the owner or occupant of the premises is not issued one of the universal keys that allows access to the lock box, the owner or occupant may not remove the lock box, because the latch to the shackle arm is contained inside the chamber of the lock box. Thus, anyone with a lock box attached to a door of the premises is without piece of mind and feels vulnerable because he or she cannot remove the lock box even at nighttime when access to the premises is not required by a real estate agent or other authorized persons.

A further significant problem associated with the use of this type of lock box arrangement is the invasion of privacy encountered when a realtor is unable to contact the owner of a premises before showing the premises and arrives with the clients at an inopportune moment. In order to greatly diminish the possibility of a breach of security or privacy, the owner or occupant of a premises should be able to remove the lock box from the exterior of a door of the premises without first having to gain access to the interior chamber of the lock box, thereby providing piece of mind for the owner or occupant, and similarly, piece of mind for the realtor, since he does not have to provide the owner or occupant with a universal key which could be used to gain access to any of the multiple lock boxes to which the realtor has access.

From the realtor's point of view, he or she has an ethical duty to disclose to a perspective client the inherent risk associated with the current lock box type system of showing the premises. This may be perceived as an unprofessional way of doing business and influence a perspective client's attitude if the client feels threatened by bodily harm or loss of possessions due to possible unauthorized access to his or her premises.

Therefore, there is a strong felt yet unfulfilled need for a device according to the instant application, which provides a first and second locking means, the first locking means being directed solely to the chamber within the lock box, and the second locking means being directed solely to the shackle arm which secures the lock box to a door knob or the like. Thus, the owner or occupant of a premises may remove the lock box but not its contents, so that when a realtor has a confirmed appointment to show the premises the owner or occupant may install the lock box in the appropriate position thereby providing the necessary access. However, at night when the owner or occupant may feel vulnerable, the lock box itself can be removed which reduces the likelihood of unauthorized access to the premises. Furthermore, the owner or occupant can ensure that the real estate agent or authorized person confirms appointments before arriving at the premises.

The patent to Piche refers to first and second locking means, however indexing the code to the first locking means also provides access to disengage the second locking means, thus access to the interior chamber also allows removal of the shackle arm from the site to which it is affixed. Common to all the patents cited is the fact that the lock box itself cannot be removed without first gaining access to the interior chamber, an arrangement which is fraught with the above-mentioned shortcomings. The present disclosure is distinguished in that it overcomes the problems that are associated with prior art devices. Therefore, none of the above citations anticipate, contemplate nor render obvious that which is taught and claimed in the instant application.

SUMMARY AND OBJECTS OF THE INVENTION

Accordingly, it is a primary object of the present invention to provide an article safe or lock box with two separate and distinct locking means, one being solely directed to accessing an interior chamber and another being solely directed to releasing the shackle arm which secures the lock box to a desired site.

It is another object of the present invention to provide an article safe or lock box which allows the owner or occupant of a premise to install and remove the lock box at the desired site without being able to gain access to the interior chamber of the lock box, thus reducing the likelihood of unauthorized access to the owner or occupant's premises.

It is a further object of the present invention to provide an article safe or lock box which alleviates the problem of invasion of privacy by allowing the owner or occupant of a premises to install the lock box at the desired site for a limited time only thereby preventing access without prior notice.

It is a still further object of the present invention to provide an article safe or lock box with a limited access to an interior chamber which may contain, for instance, a key to provide access to a home, apartment, car, boat, compartment or the like or contain information desired to be given on a restricted basis.

It is still another object of the present invention to provide an article safe or lock box with an adjustable shackle arm capable of securing the lock box to sites or objects of various dimensions such as door knobs, car handles, pipes or the like.

It is still another object of the present invention to provide an article safe or lock box with a locked interior chamber that can only be accessed by use of a master key or code. Furthermore, once access is gained to the interior chamber another key or code is required to remove the lock box itself from the site to which it is secured thereby reducing the likelihood of theft of the lock box by those individuals possessing a master key.

It is yet a further object of the present invention to provide a article safe or lock box which is strong, lightweight, weather resistant, and is designed to take advantage of mass production techniques.

These and other objects will be made manifest when considering the following detailed specification taken in light of the appended drawings.

BRIEF DESCRIPTION OF THE DRAWING FIGURES

DESCRIPTION OF THE PREFERRED EMBODIMENT

Figure 1:
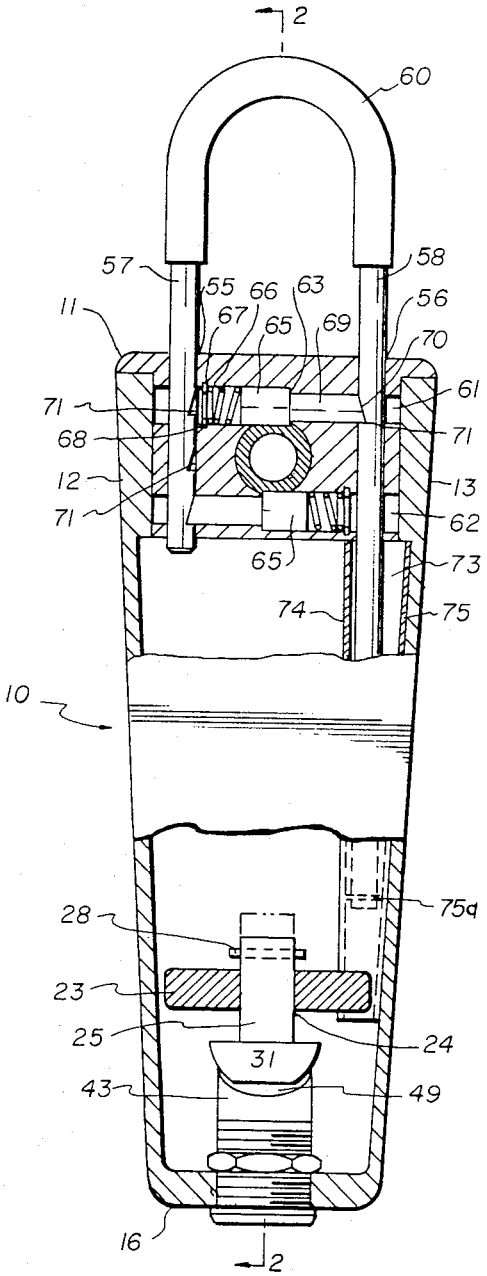
FIG. 1 is a front sectional view of the device according to the instant application.

Referring now to the drawings in detail wherein like reference numerals represent like parts throughout the several drawing figures, reference numeral 10 refers generally to the article safe or the lock box which is the subject matter of the instant disclosure.

The main body of the lock box 10 is defined by a substantially box-shaped, tapered housing with an open top end adapted to receive a top cap plug 11. The housing 10 is defined by two side walls 12 and 13, a rear wall 14, a front wall 15 and a bottom wall 16. The walls of the housing 10 define an interior chamber 17 adapted to receive small articles such as keys. The front wall 15 is provided with a stepped lip portion 18 which circumscribes a large opening in the front wall 15 adapted to receive and mate with a lockable cover 19 which provides limited access to the interior chamber 17. The cover 19 has a rabbeted upper edge portion 20 for flush and secure engagement of the cover 19 with the lip 18 of the front wall 15. The bottom edge 21 of the cover 19 coacts with a stop ledge 22 provided on the lower portion of the front wall 15 to prevent the cover 19 from disengagement. When installed the cover 19 is in a contiguous relationship with the front wall 15.

A flange member 23 protrudes inwardly from a bottom portion of the cover 19 and is provided with a vertically disposed passage 24 to slidably receive the latch mechanism 25. The flange member 23 is further provided on an upper surface with a trough 26 and a spring clip 27 adapted to receive and secure a key or similar object deposited therein. The flange member 23 is provided on an end surface with a recess 29 to receive a spring 30 which coacts with the back wall 14 to pop open the door 19 when the latch mechanism 25 is released.

The latch mechanism 25 is provided on an upper portion thereof with a stop pin 28 to prevent disengagement from the flange member 23. The latch mechanism 25 has a lower foot portion 31 with an arcuate bottom surface 33 and a flat top surface 32. The top surface 32 is provided with a recess 34 and a spring 35 to bias the latch mechanism 25 in a downward direction. The latch mechanism 25 has a lower beveled edge surface 36 which coacts with and securely engages a similar surface on the lower lip 18 of the front wall 15, thereby locking the cover 19 in place.

Figure 3:
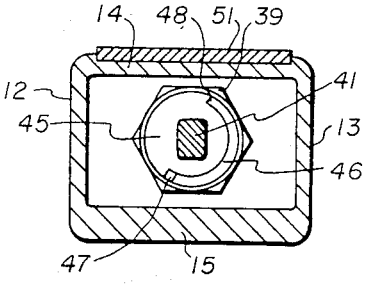
FIG. 3 is a bottom sectional view taken along lines 3—3 of that which is shown in FIG. 2.

A lock mechanism 37 is received in a passage 38 provided in the bottom wall 16, the lock mechanism 37 being secured by a nut 39 which engages the threads on the tumbler portion 40 of the lock mechanism 37. A substantially rectangular key 41 protrudes from the lock mechanism and engages the keyway 42 provided in the cylindrical latch actuating cam 43 which is secured to the key 41 by a lock pin 44. A flat stop washer 45 is interposed between the cam 43 and the tumbler portion 40 and is provided with an arcuate peripheral cutaway 46 (FIG. 3) which rotates when the key K1 is turned.

The cutaway 46 terminates at a step 48 which engages a stop pin 47 attached to the tumbler 40 so that the key K1 and the cam 43 cannot be rotated more than 180°. The cam 43 has a sloped upper surface 49 with a flat portion 50 at its apex. The arcuate surface 33 of the latch mechanism rests on the sloped surface 49 of the cam 43 so that rotation of the cam cylinder 43 ramps the latch mechanism 25 in an upward direction thereby releasing the cover 19 which pops open allowing access to the inner chamber 17.

The bottom key K1 is of the non-duplicable type such as that provided by Ace.

A rubber bumper 51 is provided on the rear wall 14 at a lower position to prevent the housing 10 from marring any surface in close proximity thereto.

The top cap 11 is a casting permanently affixed in the top opening of the housing 10. The top cap 11 is provided with a pair of spaced-apart bores 55 and 56 passing therethrough vertically and adapted to slidably receive the two legs 57 and 58 of the shackle arm 59 which is coated on a U-shaped portion thereof with a rubber coating 60. The cap 11 is further provided with two stepped bores 61 and 62 which each transversely intersect the shackle bores 55 and 56 respectively. The upper transverse bore 61 changes diameter at a substantially central position thereby creating an annular step 63 which acts as a stop for a plunger latch 65 which is similarly stepped. The plunger latch 65 is slidably disposed within the transverse bore and outwardly biased by a spring 66 which coacts with a spring clip 67, such as a Wadel clip, that is installed within a groove 68 in the transverse bore 61. The plunger latch 65 has a stepped down neck 69 with an outwardly disposed sloped end surface 70 designed for secure engagement with similarly shaped triangular notches 71 appearing on the inner surfaces of the two shackle legs 57 and 58. When the plunger latches 65 engage the notches 71, the shackle arm 59 is locked in position and cannot be withdrawn from the cap 11. The lower plunger latch 65 residing in the lower transverse bore 62 is biased in the opposite direction from the upper plunger latch so that both shackle legs 57 and 58 respectively are secured by latches.

The series of notches 71 appearing on the shackle leg 57 permit the shackle arm 59 to be secured in a variety of positions, thereby allowing the lock box to be fastened to objects of varying dimensions. The longer shackle arm 58 resides within a cavity 73 which is defined by web member 74 and 75 which depend from the side wall 13 and completely enclose the shackle leg 58. The bottom of the shackle leg 58 is provided with a stop in the form of spring clip **75*a* so that when the shackle is in the open position it cannot be completely disengaged from the cap 11**.

Figure 2:
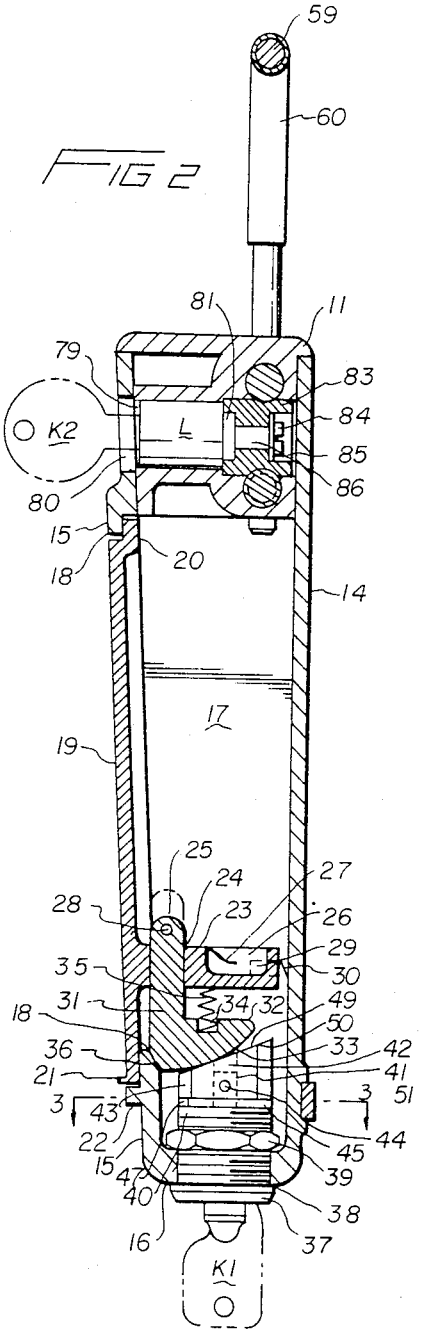
FIG. 2 is a sectional view taken along lines 2—2 of that which is shown in FIG. 1.
Figure 4:
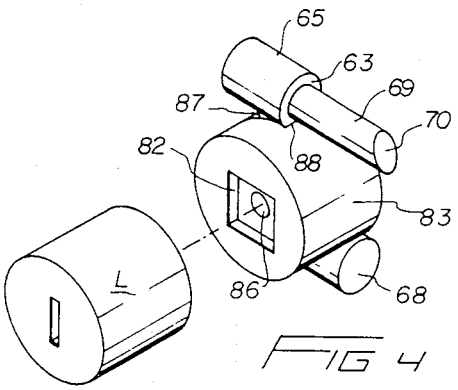
FIG. 4 is a perspective view of the upper locking mechanism and the latching devices operatively associated therewith.

As shown in FIG. 2, the shackle arm lock L, which may be one of the variety of different locks, rotatably resides within a centrally disposed bore 79 in the cap 11 which aligns with an orifice 80 in the front wall 15. The rear of the lock mechanism L is provided with a square protuberance or key 81 which engages a similarly configured recess 82 in the latch actuation cylinder 83, as best shown in FIG. 4. The rotatable latch actuation cylinder 83 is operatively connected to the lock key 81 by means of a bolt 84 which resides in a recess 85 at the rear of the latch actuation cylinder 83 and passes through a centrally disposed bore 86 in the cylinder 83. Thus, the rotation of the lock L rotates the latch actuation cylinder 83. The actuation cylinder 83 has on a top surface and on a bottom surface two arcuate grooves 87 that create a step 88 which engages the shoulder 63 of the shackle latch 65 whereby rotation in a counterclockwise direction of the actuation cylinder 83 disengages the latch end 70 from the notches 71 in the shackle legs 57 and 58 so that the shackle arm may be withdrawn to the open position. When the key K2 is released the springs 66 bias the shackle latch 65 toward the shackle legs into operative engagement with the notches 71, thereby locking the shackle arm 59 in any of the adjustable positions.

It should be noted that the lock L for the shackle arm 59 can only be actuated by key K2 and is completely independent from the lock actuated by key K1. Furthermore the shackle arm 59 cannot be disengaged even after access has been gained to the interior chamber 17. It should be noted that the positions of the two locks can be varied without departing from the spirit of the invention.

In use and operation the owner or occupant of a residence may provide a limited access thereto by installing the lock box according to the instant application on an exterior door knob to the premises with a key to the premises contained therein thus providing limited access to the premises to those individuals who possess a master key that allows access to the interior chamber of the lock box. The owner or occupant can remove the lock box itself but not its contents, unless he or she also has a master key. This arrangement reduces the vulnerability to unauthorized access, because the owner or occupant can remove the lock box during those times when access is not required to the premises, such as the night time.

Having thus described the preferred embodiment of the invention, it should be understood that numerous structural modifications and adaptations may be resorted to without departing from the spirit of the invention.

What is claimed is:

1. An article or key safe comprising in combination:

a housing, said housing having an open top, side walls, a rear wall, a bottom wall, and a front wall with an opening therein, a cap closing said open top, said walls and said cap defining an interior chamber, a shackle having a pair of spaced-apart legs slidably disposed through yet retained by said cap, first locking means operatively associated with latch means carried within said cap to engage said shackle, whereby said shackle can move from a first locked position which secures said key safe to a door handle or the like, to a second open position allowing removal of said key safe, a removable cover closing said opening in said front wall, whereby removing said cover allows access to said interior chamber and its contents, second locking means operatively associated with said cover which in a first operative position secures said cover in a locked relationship with said front wall completely covering said opening, and in a second inoperative position allows the removal of said cover from said opening revealing said interior chamber wherein said cover has a rabbetted upper edge which engages a complimentary configured edge on an upper lip of said opening in said front wall such that the outer surface of said cover is flush with the outer surface of said front wall when said cover is in a locked position, a transversely disposed web member extending inwardly from a bottom portion of said cover, an end of said web member being in close proximity to said rear wall and spring biased outwardly therefrom, said web member having an upwardly disposed trough therein with a spring clip to retain small objects such as keys within said trough, a vertical passage through said web member between said trough and a back surface of said cover, said passage slidably retains a downwardly biased, substantially L-shaped cover latch with a beveled edge on a bottom surface thereof which coacts with a similar bevel on an inner face of a bottom lip of said opening in said front wall, whereby when said beveled latch surface is in contact with said beveled lip surface said cover is in locked relationship with and completely covers said opening in said front wall, preventing access to said interior chamber, an arcuate cam surface on the bottom of said cover latch which when ramped upwardly disengages said beveled edge on said cover latch from said beveled face on said inner lip of said opening, whereby said cover pops open due to said spring disposed on said end of said web member.

2. The device of claim 1 wherein said second locking means is disposed and secured through an orifice in said bottom wall, a cam cylinder with a sloped upper surface operatively contacting said cam surface on the bottom of said cover latch, said cam cylinder keyed and affixed on a bottom surface thereof to a key extending from said second locking means, whereby rotating said second locking means rotates said cam cylinder ramping upwardly said cover latch, unlocking and releasing same.

3. The device of claim 2 wherein said shackle has one longer leg that extends within an enclosed pocket formed from web members extending from said rear wall, said longer leg being provided with stop means on a bottom portion thereof to prevent said shackle from removal from said cap.

4. The device of claim 3 wherein a U-shaped portion of said shackle is coated with a relatively soft material to prevent said shackle from damaging any surface around which it is secured and, a soft bumper disposed on a lower portion of a back surface of said rear wall to prevent said key safe from damaging any proximate surfaces at an installation site.

5. The device of claim 4 wherein said first locking means is provided with a limited edition key which opens only said shackle on one said key safe and, said second locking means is provided with a nonduplicable universal key which opens said cover providing limited access to said interior chamber on a number of said key safes.

6. The device of claim 5 wherein said cap is provided with two of said parallel spaced-apart transverse passages, one of said passages intersecting an upper portion of said central bore and the other of said passages intersecting a lower portion of said central bore, each of said passages containing one of said shackle latch arms biased outwardly in opposite directions, whereby each of said shackle legs receives one of said shackle arm ends.

7. An article or key safe comprising in combination:

a housing, said housing having an open top, side walls, a rear wall, a bottom wall, and a front wall with an opening therein, a cap closing said open top, said walls and said cap defining an interior chamber, a shackle having a pair of spaced-apart legs slidably disposed through yet retained by said cap, first locking means operatively associated with latch means carried within said cap to engage said shackle, whereby said shackle can move from a first locked position which secures said key safe to a door handle or the like, to a second open position allowing removal of said key safe, a removable cover closing said opening in said front wall, whereby removing said cover allows access to said interior chamber and its contents, a singular second locking means operatively associated with said cover which in a first operative position solely secures said cover in a locked relationship with said front wall completely covering said opening, and in a second inoperative position solely allows the removal of said cover from said opening revealing said interior chamber;

wherein said second locking means is secured through an orifice in a bottom portion of said housing, a cam cylinder with a sloped upper surface operatively contacting a cam surface on a bottom of a cover latch, said cam cylinder keyed and affixed on a bottom surface thereof to a key extending from said second locking means, whereby rotating said second locking means rotates said cam cylinder ramping upwardly said cover latch, unlocking and releasing same.

8. A lock comprising in combination:

a housing having an interior and a portal communicating said interior with areas external said housing, a cover dimensioned to occlude said portal, a solitary locking means fixedly securing said cover to said housing, actuation of said solitary locking means moving said cover from locking engagement with said housing to exposing said housing interior, a shackle supported by said housing having a first segment extending beyond said housing and a second segment within said housing yet not accessible from said housing interior whereby access to said interior does not provide communication with said shackle second segment, and shackle locking means passing through said housing isolated from said interior and operatively connected to lock and unlock said shackle, said shackle locking means inaccessible form said interior to thereby provide two distinct locking systems;

wherein said solitary locking means is secured through an orifice in a bottom portion of said housing, a cam cylinder with a sloped upper surface operatively contacting a cam surface on a bottom of a cover latch, said cam cylinder keyed and affixed on a bottom surface thereof to a key extending from said solitary locking means, whereby rotating said solitary locking means rotates said cam cylinder ramping upwardly said cover latch, unlocking and releasing same.

9. The device of claim 7 wherein said shackle has one longer leg that extends within an enclosed pocket formed from web members extending from said rear wall, said longer leg being provided with stop means on a bottom portion thereof to prevent said shackle from removal from said cap.

10. The device of claim 8 wherein said shackle has one longer leg that extends within an enclosed pocket formed from web members extending from a rear wall, said longer leg being provided with stop means on a bottom portion thereof to prevent said shackle from removal from a cap.

11. The device of claim 9 wherein a U-shaped portion of said shackle is coated with a relatively soft material to prevent said shackle from damaging any surface around which it is secured and, a soft bumper disposed on a lower portion of a back surface of said rear wall to prevent said key safe from damaging any proximate surfaces at an installation site.

12. The device of claim 10 wherein a U-shaped portion of said shackle is coated with a relatively soft material to prevent said shackle from damaging any surface around which it is secured and, a soft bumper disposed on a lower portion of a back surface of said rear wall to prevent said key safe from damaging any proximate surfaces at an installation site.

13. The device of claim 11 wherein said first locking means is provided with a limited edition key which opens only said shackle on one said key safe and, said second locking means is provided with a nonduplicable universal key which opens said cover providing limited access to said interior chamber on a number of said key safes.

14. The device of claim 12 wherein shackle locking means is provided with a limited edition key which opens only said shackle on one said key safe and, said solitary locking means is provided with a nonduplicable universal key which opens said cover providing limited access to said interior chamber on a number of said key safes.

15. The device of claim 13 wherein said cap is provided with two of said parallel spaced-apart transverse passages, one of said passages intersecting an upper portion of said central bore and the other of said passages intersecting a lower portion of said central bore, each of said passages containing one of said shackle latch arms biased outwardly in opposite directions, whereby each of said shackle legs receives one of said shackle arm ends.

16. The device of claim 14 wherein a cap is provided on a top of said housing and provided with two of said parallel spaced-apart transverse passages, one of said passages intersecting an upper portion of said central bore and the other of said passages intersecting a lower portion of said central bore, each of said passages containing one of said shackle latch arms biased outwardly in opposite directions, whereby each of said shackle legs receives one of said shackle arm ends.

* * * * *